United States Patent [19]

Lacey

[11] 4,337,006

[45] Jun. 29, 1982

[54] DEVICE FOR PREPARING AND CLEANING TRENCH FOR AN AQUIFER RECHARGING SYSTEM

[76] Inventor: Edward H. Lacey, Trent, S. Dak. 57065

[21] Appl. No.: 74,872

[22] Filed: Sep. 12, 1979

Related U.S. Application Data

[63] Continuation-in-part of Ser. No. 898,392, Apr. 19, 1978, Pat. No. 4,199,272.

[51] Int. Cl.[3] ..... E02B 11/00

[52] U.S. Cl. ..... 405/176; 210/270; 405/50

[58] Field of Search ..... 405/14 A, 176, 178, 405/177, 179, 50, 36; 210/270, 271

[56] References Cited

U.S. PATENT DOCUMENTS

| | | | |
|---|---|---|---|
| 2,315,254 | 3/1943 | Fraser | 210/270 |
| 2,335,749 | 11/1943 | Fraser | 210/271 |
| 2,393,395 | 1/1946 | Millard | 405/176 |
| 3,412,862 | 11/1968 | Chaplin | 210/270 |

FOREIGN PATENT DOCUMENTS

| | | | |
|---|---|---|---|
| 608890 | 5/1978 | U.S.S.R. | 405/176 |
| 657132 | 4/1979 | U.S.S.R. | 405/176 |
| 649777 | 5/1979 | U.S.S.R. | 405/176 |

*Primary Examiner*—William F. Pate, III

[57] ABSTRACT

A device for preparing a trench or dam for the recharging of an aquifer or similar use and for cleaning the recharging means. The aquifer recharging means is shown in my U.S. Pat. No. 4,199,272. The trench preparing device includes a protective frame surrounding one or more rolls of membrane adapted to be played out as the frame is pulled through the trench to line the trench. A gate-type mechanism is provided to prevent dirt or gravel from entering the frame as the membrane is pulled out.

20 Claims, 15 Drawing Figures

DEVICE FOR PREPARING AND CLEANING TRENCH FOR AN AQUIFER RECHARGING SYSTEM

BACKGROUND AND SUMMARY OF THE INVENTION

The application is a continuation in part of my previous application, Ser. No. 898,392, filed Apr. 19, 1978, now U.S. Pat. No. 4,199,272, and pertains to the devices used to prepare and clean the aquifer recharging means described in that patent.

Aquifers of shallow or moderate depth are a common source of water used for irrigation and sometimes for municipal water systems. These aquifers are often found in broad flat flood plains of slow running rivers. It would be expected that the river would recharge the aquifer. However, the river beds of such rivers are frequently silted tightly so that the water does not seep into the aquifer. Then, the aquifer is recharged only when the river is at flood stage or by rain water or snow melt.

In order to provide for any other recharging of the aquifer it is necessary to remove or by-pass the bottom siltation in the river. The common means for recharging is to dig a large pit down to the level of the aquifer gravel or sands, then to fill the pit with gravel and filter sand and then to pump water from the river into the pit. However, the silt from the river water again soon fills the filter sand with silt which again blocks the water from flowing through the filter sand and the recharging pit is again ineffective. It is then necessary to dry the pit and replace the sand.

In addition to adding underground water to an aquifer, it may be desirable to block the flow of underground water not only from an aquifer recharging trench but also to block the flow from footings for a dam or other structure, or from a shallow aquifer into surrounding subterranean areas.

By my invention I provide a means for lining a trench on one or both walls with a membrane impervious to water so that water can be confined either in a specific place or outside of certain space. The device may be used in conjunction with a trencher and requires no separate power means although it may also be used separately. In addition, I provide novel means for cleaning an aquuifer recharging filter bed.

FIGURES

Figure 1:
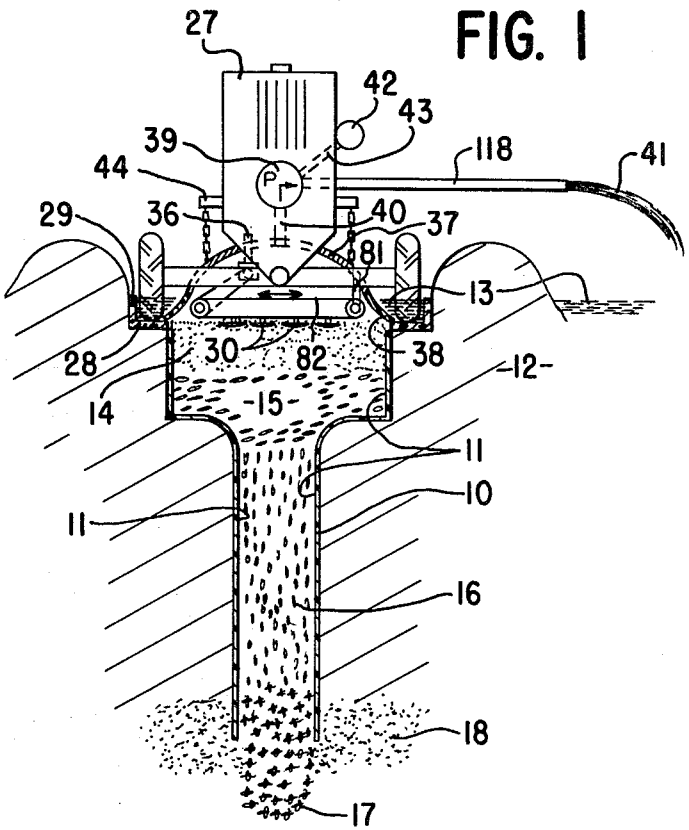
Figure 2:
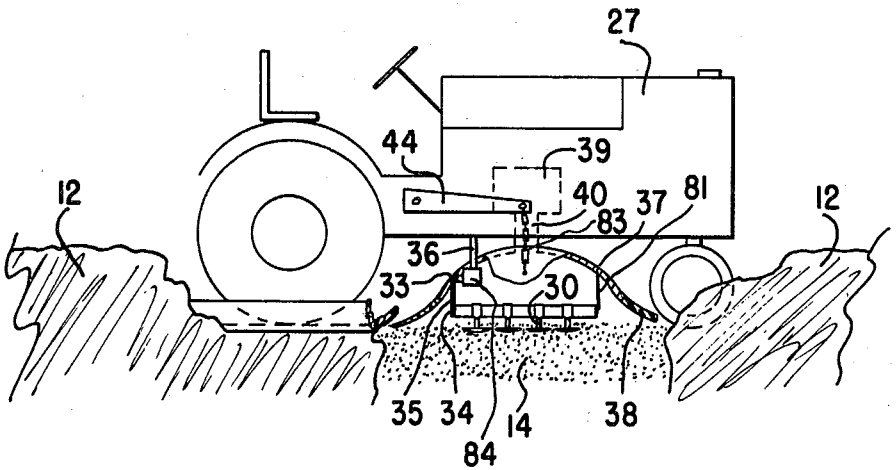
Figure 3:
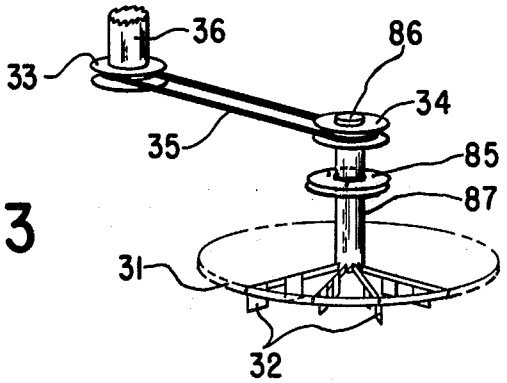
Figure 4:
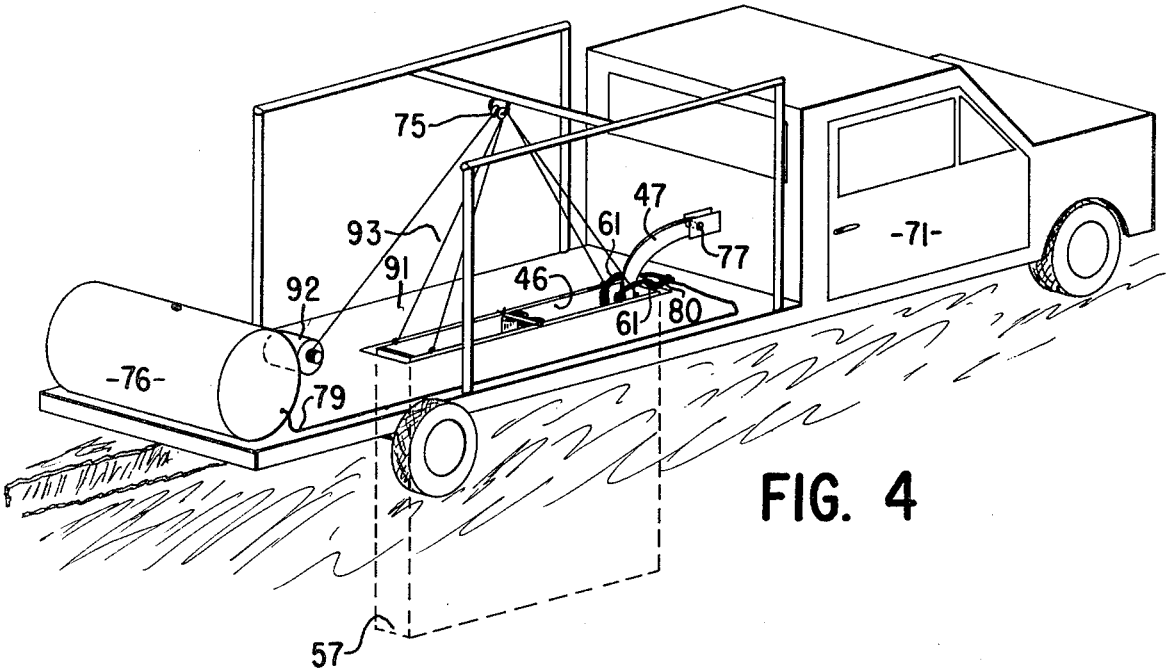
Figure 6:
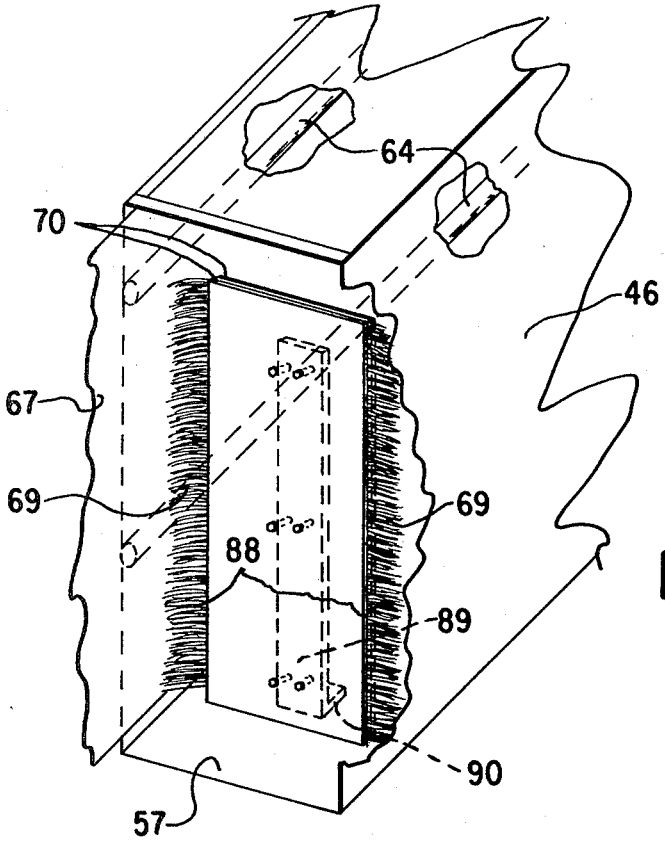
Figure 8:
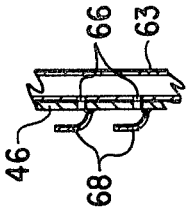
Figure 9:
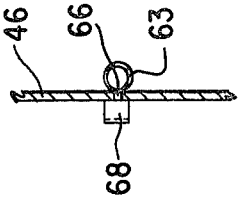
Figure 5:
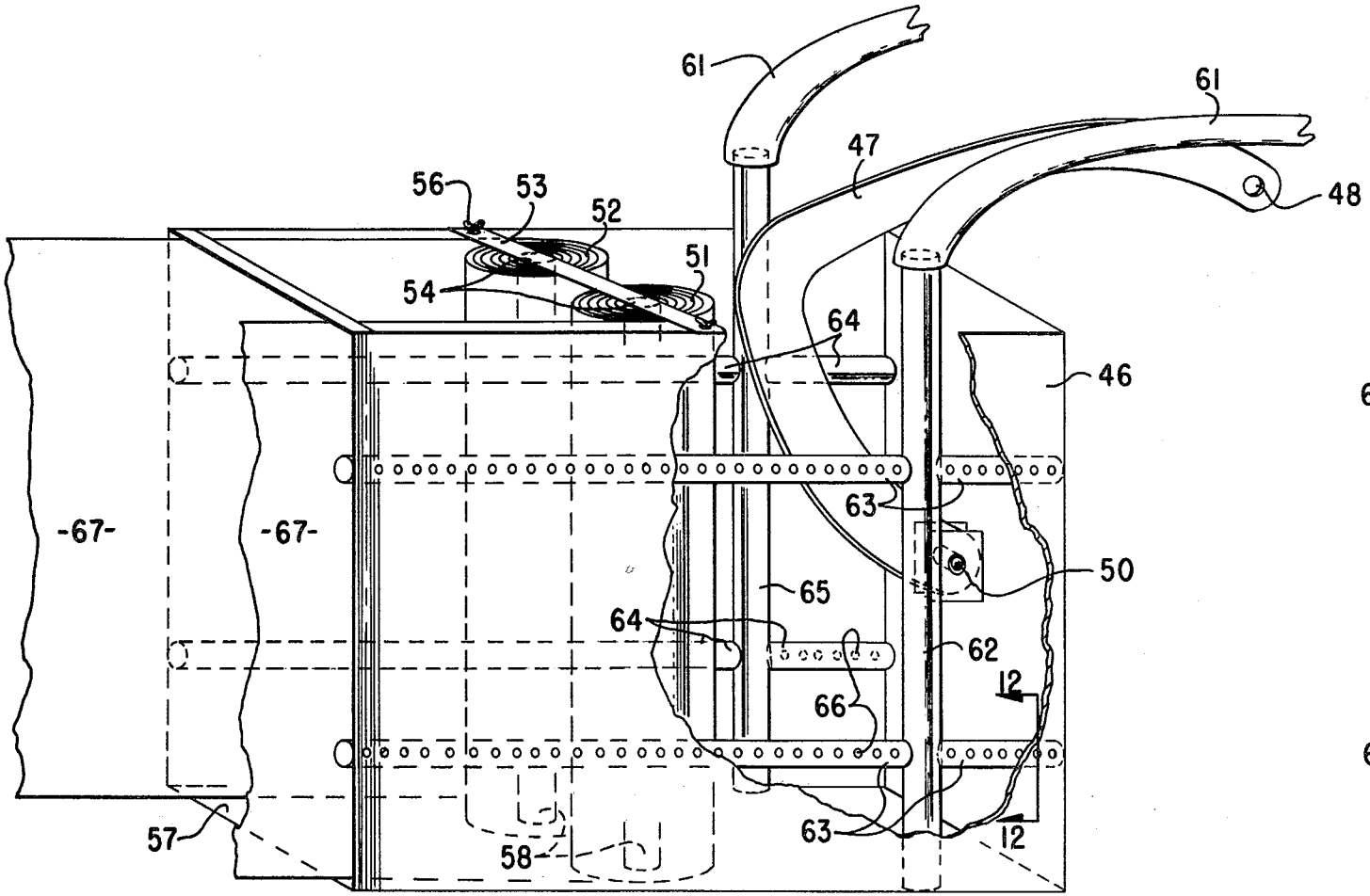
Figure 7:
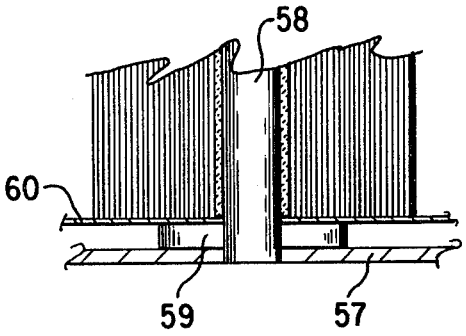
Figure 10:
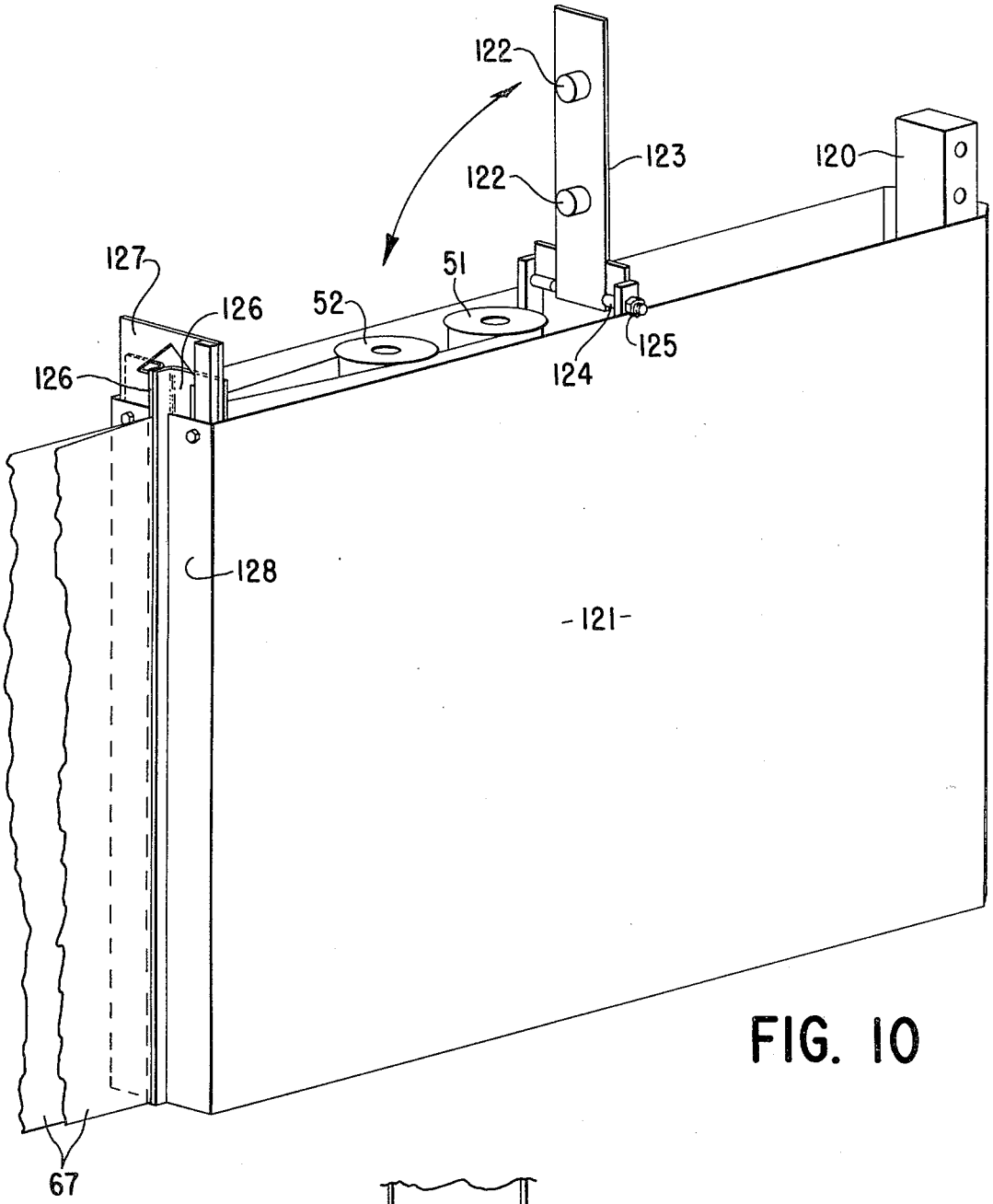
Figure 11:
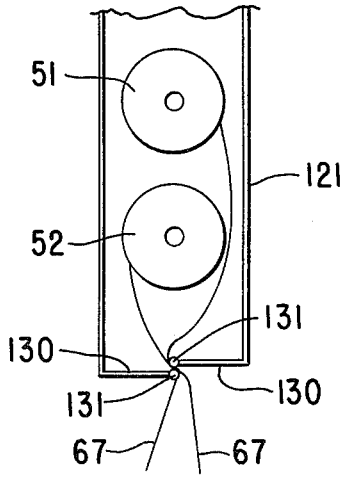
Figure 13:
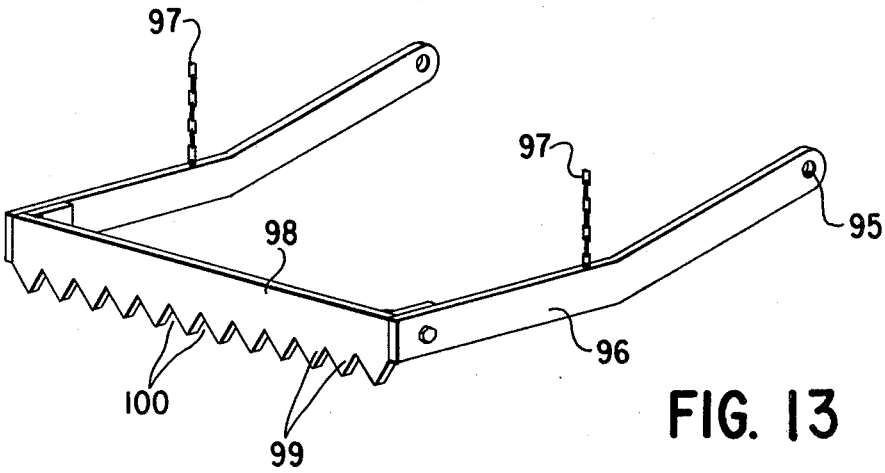
Figure 12:
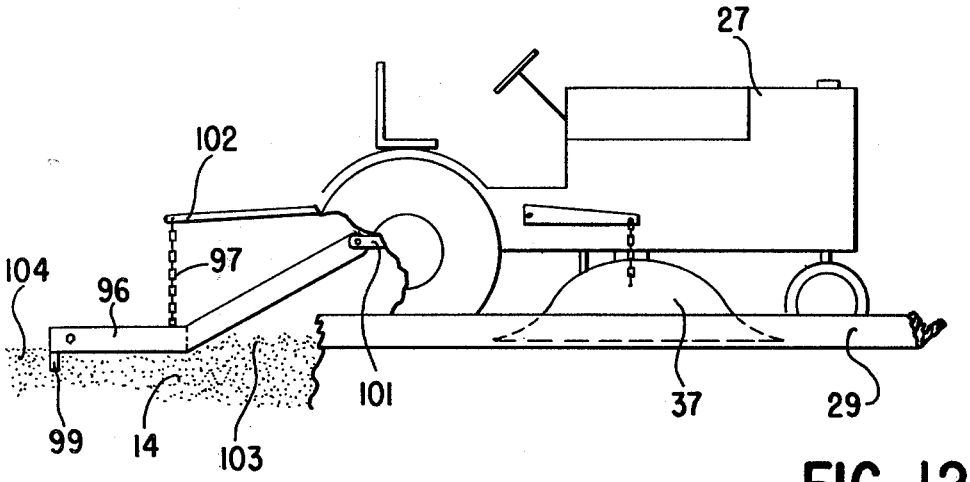
Figure 14:
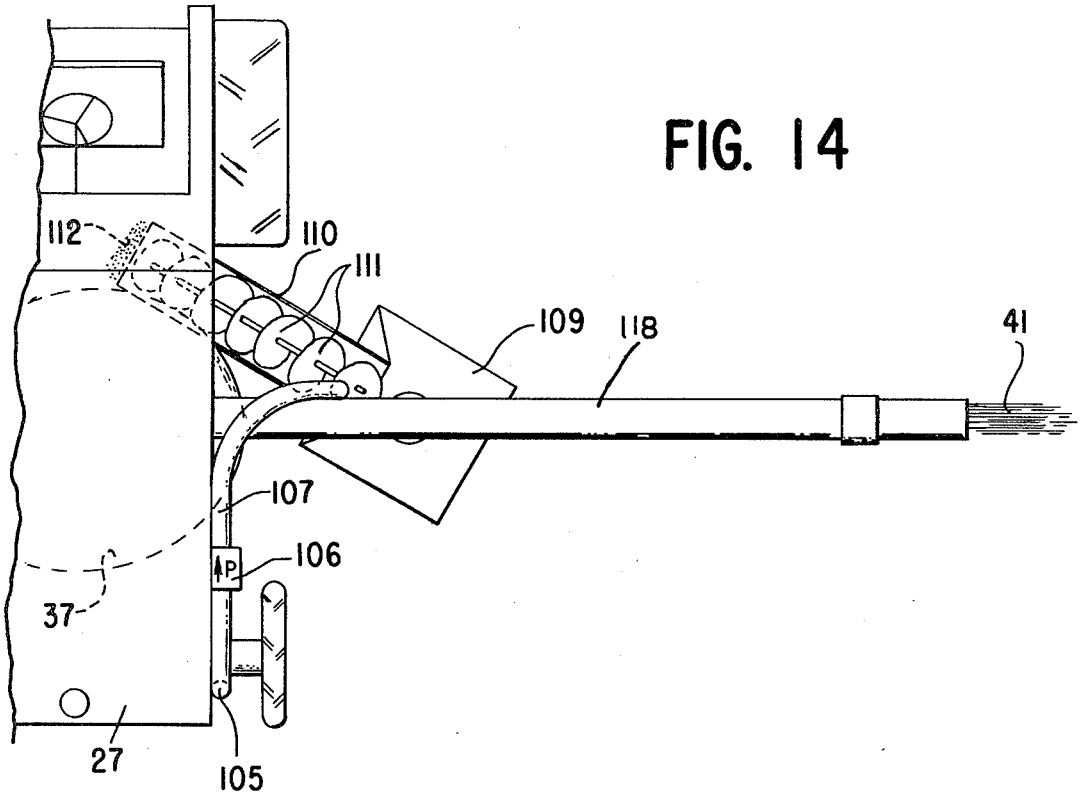
Figure 15:
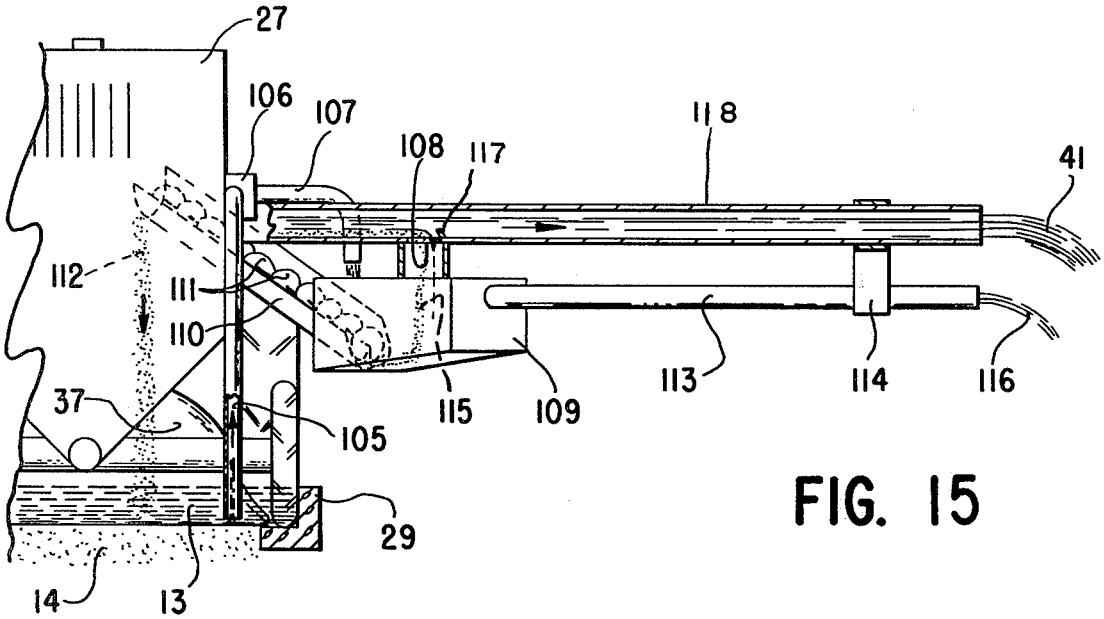

FIG. 1 is a front elevational view of the filter bed cleaning machine in place over an aquifer recharging trench, FIG. 2 is a side elevational view of the machine, FIG. 3 is a pictorial detailed view of one type of agitator that could be used on the cleaning machine, FIG. 4 is a pictorial view of the trench lining mechanism in place on a truck, FIG. 5 is an enlarged pictorial view of the trench liner placing mechanism, FIG. 6 is a rear pictorial view showing the discharge end of the liner placing mechanism, FIG. 7 is an enlarged detail view of the lower end of a liner roll in place, FIG. 8 is a detailed top sectional view of the wall lubricating means showing the lubricating parts and anti-plugging dirt covers, FIG. 9 is an end sectional view of the lubricating means shown in FIG. 8, FIG. 10 is a view similar to FIG. 6 of an alternate mechanism which may be used with a tractor, FIG. 11 is a top plan view of still another type of gate mechanism usable on the trench lining device shown in FIG. 10, FIG. 12 is a side elevational view of the tractor with a leveling rake attached, FIG. 13 is a detailed enlarged view of the rake, FIG. 14 is a detailed top view of the tractor showing a system for disposal of sand, water and silt pumped from the filter bed, and FIG. 15 is an elevational view of the system of FIG. 13 with parts broken away to show underlying parts.

DESCRIPTION

This invention pertains to the aquifer recharging system which was the subject of my previous application now U.S. Pat. No. 4,199,272, issued Apr. 22, 1980. In that application I described the complete system which included a trench lined with a liner 10. The liner 10 might be integral with a plastic film 11 adapted to line not only the narrow slit trench extending into the aquifer sand 18 but also the broadened recharging flared part 15. Both the narrow trench and the flared part are filled with pea gravel 16 lying above the normal gravel pack 17 such as is used for many water wells. Above the pea gravel 16 I provide a fine filter sand bed 14 upon which the recharging water 13 is run to later filter into the aquifer 18 to recharge it.

Above the flared part 15 of the trench, I provide curbings 29 having an ell-shape with the foot 28 of the ell running inward toward the trench. As will be explained later, these curbings thus form a pair of tracks on which my novel device for cleaning the filter bed may run. Between the curbings and above the gravel layer 16 I provide a filter bed 14 of relatively fine sand.

Unique means for cleaning the filter bed of my system is illustrated in FIGS. 1, 2 and 3. The device is shown above the shallow aquifer system in which the curbing feet 28 firmly based on the surrounding ground 12 provide tracks on which a tractor 27 can run. A hood 37 is suspended from beneath the tractor by chains 83 from arms 44. The arms 44 are adapted to raise the hood or lower it as may be desired. A rubber rim or flap 38 surrounding the hood 37 provides a seal by which water from the system can be pulled out of the hood. A pump 39 is provided for the purpose of pumping water from the hood which is discharged through a pipe 118 as at 41. If necessary, a constant prime pump 42 may be used to keep the pump 39 primed through the connection 43 between the pump 42 and the pump 39.

In order to be effective, in cleaning the filter bed, the silt which often clogs the bed must be removed from the filter sand and mixed in with the charging water 13. The water carrying the silt can then be pumped out by the pump 39. The agitation is accomplished by an agitator. This agitator takes at least two forms. My preferred form is shown in FIGS. 1 and 2. The agitator consists of a series of disks 30 mounted on a belt 82. The belt is driven in an oscillating manner by a belt 35 operating through pulleys 33 and 34. Power to the pulleys may come through a shaft 36 from the tractor 27 although independent power could also be used. For example an electric or a hydraulic motor could be used for that purpose. A gear box 84 may be used to convert the rotary motion of the shaft 36 to the oscillating motion required by the belt. The agitator is supported from the hood 37 by supports 81.

The alternate agitator shown in FIG. 3 is also driven from the shaft 36. In this case a gear box for the conversion of motion is not needed so that the pulley and belt system can drive a shaft 86 more directly. The shaft 86 is journalled in a sleeve 87 which can be supported from the hood on a flange 85. A wheel 31 having open spokes supports flaps 32 extending downward from the spokes. Rotation of the wheel 31 causes the flaps to sweep the filter bed under water and therefore to stir the silt into the water. Then the pump 39 can suck out the waterborne silt and discharge it, leaving a clean sand filter bed.

Construction of the trench and lining can be easily accomplished by means of the mechanism shown in FIGS. 4, through 9. As shown in these figures, the lining mechanism may be mounted on a truck 71 and is enclosed in a container having sides 46 and a floor 57. This container is mounted so as to be vertically movable through the bed 91 of the truck. In order to avoid interference with the drive train of the truck, the device should be mounted to one side of the centerline of the truck, offset from the drive train. In some cases, it may be desirable to mount the container on a device pulled by the ditching machine. The time would thus be reduced during which the trench walls could collapse, and then placement of the gravel immediately behind the trailer carrying the container would almost certainly assure proper formation of the trench.

The lifting mechanism may be of many forms as will appear to those skilled in the art. I have illustrated a cable system including a winch 92 adapted to pull the cables 93 attached to the corners of the container 46 and running over a sheave 75. In order to prevent binding and unequal pulling, I provide a control arm 47 pivotally attached to the container at pivot 50 and to a bracket 77 mounted on the truck 71. It will be apparent that an hydraulical lifting mechanism could also be used.

The mechanism used to line the trench is best shown in FIGS. 5 and 6. A pair of rolls of plastic film or membrane 51 and 52 are each rotatably mounted on a vertical spindle 58. The spindle is journalled in a thrust bearing 59 (FIG. 7) mounted on the floor 57 of the container. The rolls of membrane 51 and 52 are supported vertically by a plate 60 fixed to the spindle 58. At the upper end of each spindle I provide a bearing 54 mounted on a cross bar or plate 53. This plate may be attached to the sides 46 of the container by wing bolts 56 or other easily detachable means so that the rolls can be replaced readily. From these rolls, the membrane sheets 67 are paid out to the rear of the unit.

As noted in the description of the system itself, the trench is filled with gravel. In order to prevent the gravel from entering the mechanism for laying the lining membranes, I provide a brush assembly 88 (FIG. 6) adapted to sweep the membrane as it runs out of the rear of the mechanism. This assembly is supported from the floor 57 of the container by a bracket 89 having a foot 90 fixed to the floor. The assembly includes a two-part wall 70 adapted to clamp brush members 69 between the two parts. The wall is adapted close the rear of the container except for the part occupied by the brushes. The brushes 69 are placed so as to press the membrane 67 against the walls 46 of the container, and thus to close completely the rear end of the mechanism making entry of gravel into the container impossible.

In order to provide for ease of pulling the device through the trench, I provide novel means for lubricating the sides 46 of the container. This means includes a series of perforated tubes 63 and 64 attached to the inner surface of both sides 46. The perforation 66 extend through the sides 46 so that liquid in the tubes can flow out and wet the sides.

Means for getting the liquid to the perforated tubes 63 and 64 includes a tank 76 mounted on the truck 71 (FIG. 4) connected by a tube or pipe 79 to a junction 80 with a pair of tubes 61. These tubes are flexible so that lifting the container does not interfere with the flow of liquid. The tubes 61 are attached to manifold tubes 62 and 65 which in turn carry the liquid to the perforated tubes 63 and 64.

I also provide means to protect the ports 66 from becoming clogged with soil from the sides of the trench. This means comprises merely small guards or covers 68' (FIGS. 8 and 9) fixed to the side 46 and having lips spaced from the side and overhanging the port. Thus, liquid can always flow from the port 66, down the side 46 and keep the side wet. Although other liquids may be used, I have found that water works well and is my preferred liquid.

An alternate liner placing device is illustrated in FIG. 10. This device is adapted to be pulled by a tractor such as the one digging the trench, or a simple tractor following a trencher and being fitted with a lifting mechanism. The lifting mechanism of the tractor is attached to a post 120 which forms the leading wall of a container 121 similar to the container 46 of the previously described mechanism.

The modified container 121 may be somewhat narrower than the container 46 because of its construction and is useful with a trencher making a narrow trench. It may be provided with a sidewall lubricating system such as just described, but I have chosen to illustrate it without such system.

In its modified form, the container holds the two rolls of film 51 and 52 as before, but in the narrow container, these are placed in tandem one behind the other rather than side by side. Also, it is possible to dispense with a full spindle and mount the rolls on stub shafts 122 both on the bottom of the container 121 and on a flap device 123 hinged to the container at 124. The flap 123 is normally heavy enough to stay engaged by its own weight. However, it can be held engaged by providing for clamping at the hinge by the tightening of a nut 125 on the bolt which provides the hinge axis.

The dual membrane sheets 67 are pulled off the rolls 51 and 52 in the same manner as described in the previous mechanism. However, because of the narrower trench, a single gate mechanism to prevent gravel from entering the container 121 may be used. Instead of using the brush assembly 88, I provide for flexible plastic strips 126 mounted on a plate 127. The strips are pressed together and bent to form a wiping mechanism through which the membrane 67 may be pulled. The strip 126 should not be so rigid that the membrane sheets 67 bind in the wiper, but should be stiff enough to prevent spreading which would allow gravel or dirt to get back into the container 121. The plate 127 can either form the rear wall of the container or can be fastened to flanges 128 forming that rear wall.

Still another type of gate mechanism is illustrated in FIG. 11. This gate may be used with the same type of container 121 as is used with the plastic strip gate. That type of gate may be subject to some binding especially when the device is used in unstable soil. If the walls of the trench are apt to collapse against the sides of the container 121, there is pressure to squeeze the sides together resulting in a binding of the gate strips 126 against the plastic film 67. The device shown in FIG. 11 avoids that problem.

In the alternate shown in FIG. 11, I simply provide rear wall flanges 130 which are slightly offset from each other. To form the gate, rods 131, or similar formations are provided at the edges of each flange 130. These rods normally engage each other lightly, but the flanges 130 are flexible enough so that the films 67 can run between the rods. Thus the gravel or other material is kept out of the container 121. In the event of pressures on the side walls of the container, any movement of those side walls is simply absorbed as slight displacement of the rods 131 transversely of the device, but there will be no binding.

When used with dual films to line a trench, the membranes 67 from this device must be spread apart manually before the gravel 16 is placed to hold the membranes against the side walls of the trench. However, I also envision that this mechanism could be used with a single roll of membrane to form an underground dam to hold or to divert subterranean water in shallow aquifers. Thus, a trench could be dug through the aquifer sand and a membrane placed to block the flow of water to hold it in a desired location. Or, the membrane might be sunk to a certain level to protect certain foundations or footings from the flow of underground water above that level. Many other similar applications will certainly occur to others skilled in the art.

For use in the filter bed of the recharging system, and in order to provide a somewhat more efficient filter bed, I propose to use a bed forming device as best shown in FIGS. 11 and 12. This device comprises a rake consisting of arms 96 pivoted at 95 to the lower members 101 of a three point hitch on the tractor 27. The upper member 102 of the hitch may be connected to the arms 96 by means of chains 97 thus providing for raising and lowering of the rake. A rake member 98 may be bolted cross ways between the arms 96. This member is formed with teeth 99 formed by notches 100 in the lower edge of the member 98. Although I have shown the rake member 98 as a solid bar, I envision that it might be desirable to perforate the bar or to fabricate it from narrow members forming an open rake so as to permit water on the filter bed freer passage through the rake.

In use, this rake is simply pulled behind the tractor 27 over the surface 103 of the sand bed 14. Ahead of the rake, that surface may be very rough and irregular because of dumping of cleaned sand as described hereafter, or may be very smooth because of the action of the water covering it. In either case, the teeth 99 as pulled over the bed will level out the discharged sand and other irregularities and form a longitudinally corrugated surface 104. This type of surface has a greater area of sand presented to the water for the water to filter through, and also provides a surface in which the silt and other clogging impurities can fall into the valleys of the corrugations while the water filters through the peaks which will remain unclogged. Thus, the filter bed becomes more efficient and will stay useful for longer periods of time.

A means for separating, cleaning and returning sand to the sand bed 14 is shown in FIGS. 13 and 14. This means is mounted on the tractor 27 and is used with the hood 37 and its associated pump and cleaning apparatus which discharges through the pipe 118. It will be evident from the foregoing description that the water being discharged from the pipe 118 will be carrying a certain amount of sand as well as silt and other clogging impurities. By the illustrated device, I propose to recover most of the sand and return it to the bed 14. In some instances it may be desirable to pick up the complete filter bed, wash the sand and return it. This is also possible with this device.

In order to accomplish my purpose, I cut a slot 108 in the bottom of the pipe 118 and provide a dam 117 at the edge of the slot toward the discharge and (at 41) of the pipe. The sand, being considerably heavier than the water will flow along the bottom of the pipe 118 and be blocked by the dam 117 and fall out through the slot 108. Some of the water may also discharge through the slot, but the amount will be relatively small and inconsequential.

The sand 115 falling from the slot is caught by a hopper 119 supported beneath the slot 108. From this hopper, it is removed by an auger 111 running in a trough 110. To prevent silt and the like from being returned to the bed with the sand in the trough 110, I provide for water to be pumped from the recharging water 13 through a pipe 105 mounted at the front of the tractor. The pump 106 then discharges the relatively clean water through a pipe 107 onto the sand in the trough 110 and washes the lighter silt back into the hopper 109. When the level of water reaches the upper part of the hopper, an overflow pipe 113 conducts the water to a discharge end at 116 at approximately the same place as the discharge 41. The pipe 113 may be carried by a support 114 attached to the pipe 118. The cleaned washed sand 112 is dropped from the trough 110 back into the bed 14 where the rake 98 will level it again to form the efficient filter which is the goal of my invention.

I claim:

1. Means for lining an aquifer recharging trench with membrane comprising carrying means, container means attached to said carrying means and adapted to extend downward into said trench, support means in said container means adapted to support at least one roll of said membrane on vertical axis, said container having sides and a rear wall means attached together to completely enclose said container from the side walls of said trench, said sides and rear wall means cooperating to form at least one slot through which said membrane can be unrolled from said roll and lie against a wall of said trench.

2. The device of claim 1 in which there are support means to support two rolls of membrane, each roll being adapted to discharge separately through one of said slots, brushes on said wall means extending into said slots adapted to press said membrane against said sides and to thereby prevent foreign material from entering said container from the open rear.

3. The device of claim 1 in which means is provided for lubricating the sides of said container.

4. The device of claim 3 in which said means for lubricating the sides of said container includes tube means extending along said sides, said tube means and sides being formed to provide communicating perforations and means to conduct a lubricating liquid to said tubes whereby said liquid will be extruded from said perforations onto the sides of said container.

5. The device of claim 4 in which said means to conduct the liquid includes a tank mounted on said carrying means and connecting pipe means between said tank and said tubes.

6. The device of claim 4 in which guard means are mounted on said sides, and extend over said perforations to prevent clogging of said perforations.

7. The device of claim 1 in which the opening at the rear is partially closed by gate means adapted to close the rear but to allow passage of said membrane.

8. The device of claim 1 in which two rolls are mounted on said support means, said rolls being arranged in tandem.

9. The device of claim 1 in which one roll of membrane is supported on said support means, gate means in said rear of the container to prevent entry into the container of dirt or gravel.

10. The device of claim 7 in which said gate means is formed of strip means attached to said container, flexible plastic means attached to said strips adapted to engage each other but separable to allow passage of said membrane therebetween.

11. The device of claim 7 in which said gate means is formed from flanges comprising the rear wall of said container, one of said flanges being offset from the other in a direction longitudinal of the container, the edges of said flanges being in light, springable contact whereby said membrane can run between said flanges.

12. The device of claim 11 in which said edges are formed as enlarged curved edges whereby said membrane will run smoothly over said edges.

13. For use with an aquifer recharging system having curbing with inward directed feet and an elongated sand filter bed between said feet, said filter bed being normally covered by water, cleaning means for sand filter bed comprising powered means adapted to ride on said feet, hood means supported from said powered means and adapted to substantially cover the width of the filter bed between said feet, said hood having edges adapted to be submerged in the water, agitator means supported from said powered means and driven thereby to agitate the surface of said filter bed and vacuum means communicating with said hood including a pump adapted to pull water including entrained impurities out of said hood, a discharge pipe extending from said pump laterally of said powered means to a point beyond said curbing whereby the discharge from said pump is carried beyond the outer limits of the filter bed, said discharge pipe being formed with a slot in its lower surface, container means below said slot and supported from said pipe adapted to receive heavy material being pumped along said pipe and dropping from said slot, and conveyor means attached to said container means adapted to pick up said heavy material and convey it back to said filter bed, said conveyor means being driven by said powered means.

14. The device of claim 13 in which dam means is provided in said pipe adjacent the downstream edge of said slot whereby said heavy material is diverted into and through said slot.

15. The device of claim 14 in which washing means is mounted on said powered means, said washing means including a pipe means adapted to direct washing material over said heavy materials in said conveyor to wash lighter impurities therefrom into said container.

16. The device of claim 15 in which an overflow pipe extends from the upper part of said container laterally of and beyond the curbing defining said filter bed whereby overflow from said container will be carried beyond the limits of said filter bed.

17. The device of claim 15 in which said washing means includes a pump mounted on said powered means, intake means extending from said pump to a point between said curbings and into the water above said filter bed whereby said water may be pulled up into said pump, and discharge pipe means from said pump extending over said conveyor means whereby said water will be discharged over the heavy material carried by said conveyor means.

18. The device of claim 14 in which said conveyor means includes a trough extending from said container to a point above said filter bed, and auger means rotatably mounted within said trough, said auger means being rotatively driven from said powered means.

19. For use with an aquifer recharging system having curbing with inward directed feet and an elongated sand filter bed between said feet, said filter bed being normally covered by water, cleaning means for said filter bed comprising powered means adapted to ride on said feet, hood means supported from said powered means and adapted to substantially cover the width of the filter bed between said feet, said hood having edges adapted to be submerged in the water, agitator means including a belt supported from said powered means, projecting means on said belt extending toward said filter bed and adapted to engage said filter bed, drive means engaged between said powered means and said belt adapted to drive said belt in a reciprocating motion transversely of said filter bed and vacuum means communicating with said hood including a pump adapted to pull water including entrained impurities out of said hood.

20. For use with an aquifer recharging system having curbing with inward directed feet and an elongated sand filter bed between said feet, said filter bed being normally covered by water, cleaning means for sand filter bed comprising powered means adapted to ride on said feet, hood means supported from said powered means and adapted to substantially cover the width of the filter bed between said feet, said hood having edges adapted to be submerged in the water, agitator means including a wheel mounted on said powered means to rotate in a substantially horizontal plane above said filter bed, flap means mounted on said wheel extending toward and adapted to sweep the upper surface of said filter bed, drive means between said powered means and said wheel to drive said wheel with a rotary motion over said filter bed, and vacuum means communicating with said hood including a pump adapted to pull water including entrained impurities out of said hood.

* * * * *